US009551537B2

(12) United States Patent
Daum et al.

(10) Patent No.: US 9,551,537 B2
(45) Date of Patent: Jan. 24, 2017

(54) HEAT EXCHANGER INCLUDING A TUBE BUNDLE THAT IS OFFSET WITH RESPECT TO A CENTER OF THE CHAMBER CASING

(75) Inventors: Karl-Heinz Daum, Mainz (DE); Hannes Storch, Friedrichsdorf (DE); Wolfram Schalk, Bad Homburg (DE)

(73) Assignee: OUTOTEC OYJ, Espoo (FI)

( * ) Notice: Subject to any disclaimer, the term of this patent is extended or adjusted under 35 U.S.C. 154(b) by 67 days.

(21) Appl. No.: 14/237,563

(22) PCT Filed: Jul. 31, 2012

(86) PCT No.: PCT/EP2012/064914
§ 371 (c)(1),
(2), (4) Date: Feb. 7, 2014

(87) PCT Pub. No.: WO2013/020854
PCT Pub. Date: Feb. 14, 2013

(65) Prior Publication Data

US 2014/0182816 A1 Jul. 3, 2014

(30) Foreign Application Priority Data

Aug. 11, 2011 (DE) ..... 10 2011 109 970

(51) Int. Cl.
*F28D 7/10* (2006.01)
*F28D 7/16* (2006.01)
*F28D 9/00* (2006.01)

(52) U.S. Cl.
CPC ..... *F28D 7/16* (2013.01); *F28D 7/1676* (2013.01); *F28D 9/0006* (2013.01)

(58) Field of Classification Search
CPC ..... F28D 7/16; F28D 7/1676; F28D 9/0006; F28F 2009/222; F28F 9/0219; F28F 2009/224

(Continued)

(56) References Cited

U.S. PATENT DOCUMENTS 2,552,416 A * 5/1951 Farkas ..... 165/84
3,118,497 A * 1/1964 Olson ..... 165/157
4,660,632 A * 4/1987 Yampolsky ..... F01K 25/08 165/158

(Continued)

FOREIGN PATENT DOCUMENTS

DE 6948856 U 3/1973
DE 4406772 C 9/1995

(Continued)

OTHER PUBLICATIONS

Eichenhofer, et al., "Schwefel und anorganische Schwefelverbindungen", Chemische Technik: Prozesse und Produkte, Band 3: Anorganische Grundstoffe, Zwischenprodukte, Dec. 2005, pp. 96-96.

*Primary Examiner* — Marc Norman
*Assistant Examiner* — Jon T Schermerhorn
(74) *Attorney, Agent, or Firm* — Leydig, Voit & Mayer, Ltd.

(57) ABSTRACT

A heat exchanger for use in a contact group of a sulfuric acid plant includes a chamber in which a tube bundle is arranged on a circular ring. A gas space is formed between the tube bundle and a chamber casing surrounding the tube bundle. A gas supply opening is provided in the chamber casing and is configured to introduce a gas into the gas space substantially radially to the tube bundle. A gas outlet opening adjoins an interior space enclosed by the tube bundle in a substantially axial direction. A center of the tube bundle is offset with respect to a center of the chamber casing in a direction opposite to the gas supply opening.

7 Claims, 1 Drawing Sheet

(58) Field of Classification Search
USPC ..... 165/157, 54, 161, 160, 159, 177, 154, 165/158
See application file for complete search history.

(56) References Cited

U.S. PATENT DOCUMENTS

| | | | | |
|---|---|---|---|---|
| 2008/0190108 | A1 | 8/2008 | Eitel et al. | |
| 2009/0068088 | A1* | 3/2009 | Daum | C01B 17/54 423/543 |
| 2010/0058784 | A1 | 3/2010 | Pek | |

FOREIGN PATENT DOCUMENTS

| | | | |
|---|---|---|---|
| EP | 0002325 | A1 | 6/1979 |
| EP | 1876391 | A1 | 1/2008 |
| GB | 618280 | A | 2/1949 |
| GB | 897593 | A | 5/1962 |
| GB | 2299768 | A | 10/1996 |
| JP | 05231793 | A | 9/1993 |
| JP | 2008530439 | A | 8/2008 |
| JP | 2010510369 | A | 3/2010 |
| WO | WO 2005043061 | A1 | 5/2005 |

* cited by examiner

HEAT EXCHANGER INCLUDING A TUBE BUNDLE THAT IS OFFSET WITH RESPECT TO A CENTER OF THE CHAMBER CASING

CROSS-REFERENCE TO PRIOR APPLICATIONS

This application is a U.S. National Phase Application under 35 U.S.C. §371 of International Application No. PCT/EP2012/064914, filed on Jul. 31, 2012, and claims benefit to German Patent Application No. DE 10 2011 109 970.4, filed on Aug. 11, 2011. The International Application was published in English on Feb. 14, 2013 as WO 2013/020854 under PCT Article 21(2).

FIELD

This invention relates to a heat exchanger, in particular for use in the contact group of a sulfuric acid plant, with a chamber in which a tube bundle is arranged on a circular ring, wherein between the tube bundle and a chamber casing surrounding the tube bundle a gas space is formed, a gas supply opening provided in the chamber casing for introducing a gas into the gas space substantially radially relative to the tube bundle, and a gas outlet opening which adjoins an interior space enclosed by the tube bundle in substantially axial direction.

BACKGROUND

Within the contact group of sulfuric acid plants tube bundle heat exchangers usually are employed, which are installed in a vertical configuration, so that possibly obtained sulfuric acid condensate can flow off towards the bottom tray and can be withdrawn there to avoid corrosion. In general, the SO2 gas is guided on the casing side and the SO2/SO3 gas is guided on the tube side. In commercial plants over 1,500 tato MH, disk-and-doughnut heat exchangers are used (cf. Winnacker/Küchler, Chemische Technik: Prozesse and Produkte, edited by Roland Dittmeyer et al., Vol. 3: Anorganische Grundstoffe, Zwischenprodukte, p. 96 f., Wiley-VCH Verlag, Weinheim, 2005).

The cold SO2 gas generally is guided in counterflow to the SO3-containing gas to be cooled. It was found out that the sulfuric acid condensate leads to a strong corrosion in particular in the first chamber of the heat exchanger, so that high-alloy and expensive stainless steel materials must be used. To reduce the costs, the heat exchanger was divided into two parts, so that in the case of excessive corrosion not the entire heat exchanger, but merely the region exposed to cold gas, in which a particularly high corrosion occurs, must be replaced. While initially assuming a uniform division of the heat transfer region, the applicant recently has employed heat exchangers in which in the cold heat-exchange section (1st chamber) only a minor part of the entire heat transfer surface was provided. Moreover, instead of an arrangement in which two vertically oriented heat exchangers are arranged one beside the other and which creates problems in terms of drainage, there was now used an arrangement in which the chamber, to which the cold SO2 gas is supplied, is arranged horizontally. From this first chamber, the sulfuric acid condensate can simply be withdrawn at the bottom. The SO2-containing gas then was transferred into the adjoining vertical section with a greater heat transfer surface. It was found out, however, that in the case of the radial approach flow of the tube bundle in the horizontal section of the heat exchanger a non-uniform gas flow and as a result an impairment of the heat transfer can occur.

SUMMARY

In an embodiment, the present invention provides a heat exchanger for use in a contact group of a sulfuric acid plant including a chamber in which a tube bundle is arranged on a circular ring. A gas space is formed between the tube bundle and a chamber casing surrounding the tube bundle. A gas supply opening is provided in the chamber casing and is configured to introduce a gas into the gas space substantially radially to the tube bundle. A gas outlet opening adjoins an interior space enclosed by the tube bundle in a substantially axial direction. A center of the tube bundle is offset with respect to a center of the chamber casing in a direction opposite to the gas supply opening.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
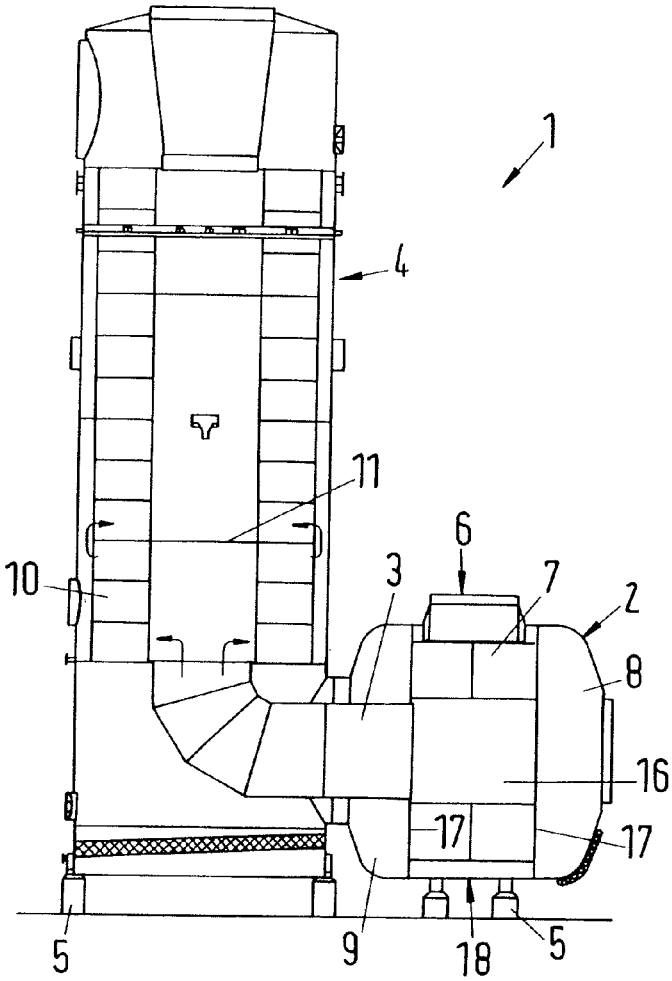
FIG. 1 schematically shows a section through a heat exchanger according to an embodiment of the invention, FIG. 2 schematically shows a section through the first chamber of the heat exchanger.

According to an embodiment of the invention it is possible to achieve a uniform heat transfer. Falling below the dew point temperature of the sulfuric acid should be avoided as far as possible.

In an embodiment of the present invention, the center of the tube bundle is offset with respect to the center of the chamber casing in a direction opposite to the gas supply opening.

In the conventional heat exchanger, the tube bundle arranged as circular ring is arranged concentrically relative to the likewise substantially cylindrically formed chamber of the heat exchanger. The present invention, however, departs from this concentricity and the tube bundle is offset with respect to the chamber casing, so that the gas space formed between the tube bundle and the chamber casing tapers to an increasing extent from a maximum width facing the gas supply opening to the opposite side of the tube bundle. During the approach flow of the gas supplied to the heat exchanger, the pressure in the gas space is more and more increased due to the taper up to a maximum on the side facing away from the gas supply opening. The increase in pressure during impingement of the gas onto the tube bundle in the region of the gas supply opening thereby can be compensated, so that over the entire circumference of the tube bundle the gas passes through the tube bundle and enters into the interior space enclosed by said tube bundle with uniform velocity. A uniform heat transfer can be ensured in all regions of the tube bundle.

In accordance with the invention, a particularly uniform flow distribution in particular is obtained when the center of the tube bundle is offset with respect to the center of the chamber casing by 30 to 70%, preferably by about 50% of the width of the centric gas space. "Centric gas space" here is understood to be the gas space as it would be achieved with a concentric arrangement of the tube bundle with respect to the chamber casing. With a cylindrical design of the chamber, the tube bundle in this case would have a uniform distance to the chamber wall over its entire circumference. The gas space also would have a uniform width. From this position, the tube bundle now is shifted by about 30 to 70% of the width of the gas space. If instead of a cylindrical chamber a polygonal or differently shaped chamber is employed, the minimum distances to the chamber wall are decisive for shifting the tube bundle. Polygon shaped chambers, however, involve disadvantages with regard to the flow distribution.

In accordance with a preferred embodiment of the invention the gas supply opening has an oval cross-section, wherein the maximum diameter of the gas supply opening preferably amounts to 70 to 95%, more preferably 85 to 90%, of the distance of tube plates defining the tube bundle in axial direction. Thus, the gas supply opening extends along the substantial length of the tube bundle.

In accordance with the invention, the main axis of the chamber is oriented substantially horizontally, so that an easy drainage of sulfuric acid accumulating in the lower region is possible. For this purpose, a drainage outlet is provided in the lower region of the chamber in accordance with the invention.

In accordance with a preferred aspect of the invention, the first chamber of the heat exchanger only includes about 10 to 30%, preferably 15 to 20%, of the entire heat-exchange surface of the heat exchanger. As a result, the temperature increase of the sulfur dioxide (SO2) can be limited to about 5-30 K, preferably 15-20 K, so that falling below the dew point temperature of the sulfuric acid largely is avoided. Correspondingly, a minimized condensation of sulfuric acid is obtained.

In accordance with a development of the invention, a vertical heat exchange section adjoins the chamber, in which a plurality of tubes are arranged in substantially vertical direction. In accordance with the invention, the vertical heat-exchange section includes about 70 to 90% of the heat-exchange surface of the heat exchanger. As in this region only minor corrosion risks exist due to the higher temperatures, the vertical heat-exchange section can be made of less expensive materials.

The gas/gas heat exchanger 1 according to the invention comprises a substantially horizontal chamber 2 which via a gas discharge tube 3 adjoining a gas outlet opening is connected with a vertical heat-exchange section 4. The horizontal chamber 2 and the vertical heat-exchange section 4 are attached to the bottom via corresponding bearings 5.

When the heat exchanger 1 is employed in a contact group of a sulfuric acid plant, cold SO2-containing gas is supplied to the horizontal chamber 2 via a gas supply opening 6. In the chamber 2, a disk-and-doughnut heat exchanger 7 is provided. The chamber 2 is closed by covers 8, 9, wherein the cover 9 facing the vertical heat-exchange section 4 is penetrated by the gas discharge tube 3.

The vertical heat-exchange section 4 also is formed as disk-and-doughnut heat exchanger, as is schematically shown in FIG. 1. The gas centrally supplied through the gas discharge tube 3 is radially deflected to the outside and passes through tube bundles 10 only schematically indicated here, in which SO3-containing gas to be cooled flows. Behind a disk 11 the SO2-containing gas is again deflected to the inside, wherein it again passes through a tube bundle 10. This design of the vertical heat exchanger 4 is common practice, so that it will not be discussed here in detail.

Figure 2:
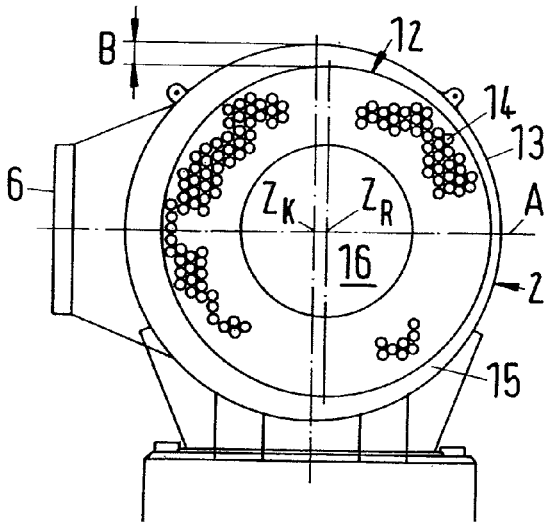

In FIG. 2, the construction of the first heat-exchange chamber 2 is shown in detail. In the substantially cylindrically formed chamber 2 a tube bundle 12 formed as circular ring is provided, which is formed by a plurality of tubes 14 extending parallel to the chamber casing 13 of the chamber 2. Between the chamber casing 13 and the tube bundle 12 a gas space 15 is provided. In the interior of the ring-shaped tube bundle 12 an interior space 16 is provided, which merges into the gas discharge tube 3. In axial direction, the tube bundle 12 is defined by tube plates (disks) 17 indicated in FIG. 1. Since the tube plates 17 are arranged vertically, sulfuric acid condensate formed can flow off downwards and an accumulation of the condensate on the tube plates causing corrosion is avoided. In the lower region of the chamber 2 at least one drainage outlet 18 is provided, in order to withdraw accumulating sulfuric acid condensate.

The gas supply opening 6 is of oval shape, wherein the largest diameter of the oval gas supply opening 6 amounts to about 70 to 95% of the distance of the tube plates 17 and hence of the length of the tube bundle 12. As a result, the SO2-containing gas supplied through the gas supply opening 6 is introduced into the gas space 15 substantially along the entire length of the tube bundle 10.

As is clearly shown in FIG. 2, the tube bundle 12 is offset with respect to the chamber casing 13. In accordance with the invention, the offset here is chosen such that the center ZR of the tube bundle is offset with respect to the center ZK of the chamber 2 by 30 to 70%, in particular by about 50% of the width B of the centric gas space (determined with a tube bundle 12 fictitiously concentrically arranged in the chamber 2).

When the SO2-containing gas now is introduced into the chamber 2 through the gas supply opening 6, it is spread in the gas space 15 and subsequently radially flows between the tubes 14 of the tube bundle 12 into the interior space 16. Due to the offset arrangement of the tube bundle with respect to the chamber casing 13, a uniform radial flow of the gas is obtained over the entire circumference of the tube bundle 12. As a result, a uniform heat transfer over the entire circumference of the tube bundle and hence a more effective heat exchange is achieved.

The SO2-containing gas entering into the interior space 16 and heated by heat exchange with the gas flowing in the tube bundle 12 is introduced into the vertical heat-exchange section 4 via the gas discharge tube 3 and further heated in counterflow to the SO3-containing gas mostly introduced from above into the vertical heat-exchange section 4.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 heat exchanger
2 chamber
3 gas discharge tube
4 vertical heat-exchange section
5 bearing
6 gas supply opening
7 disk-and-doughnut heat exchanger
8, 9 covers
10 tube bundle
11 disks
12 tube bundle
13 chamber casing
14 tubes
15 gas space
16 interior space
17 tube plates
18 drainage outlet
A main axis of the chamber 2
B width of the gas space 15
ZK center of the chamber 2
ZR center of the tube bundle 12

The invention claimed is:

1. A heat exchanger for use in a contact group of a sulfuric acid plant, comprising:

a chamber in which a tube bundle is arranged on a circular ring, a gas space formed between the tube bundle and a chamber casing surrounding the tube bundle;

a gas supply opening provided in the chamber casing and configured to introduce a gas into the gas space substantially radially to the tube bundle;

a gas outlet opening which adjoins an interior space enclosed by the tube bundle at a center of the tube bundle and is configured to allow the gas to exit the center of the tube bundle substantially axially to the tube bundle; and a vertical heat-exchange section disposed subsequent to the gas outlet opening of the chamber, the vertical heat-exchange section including a plurality of tubes arranged in a substantially vertical direction, wherein the center of the tube bundle is offset with respect to a center of the chamber casing in a direction opposite to the as supply opening, and wherein the vertical heat-exchange section includes about 70 to 90% of the heat-exchange surface of the heat exchanger.

2. The heat exchanger according to claim 1, wherein the center of the tube bundle is offset with respect to the center of the chamber casing by 30 to 70% of a width of a centric gas space.

3. The heat exchanger according to claim 1, wherein the gas supply opening has an oval cross-section.

4. The heat exchanger according to claim 1, wherein a maximum diameter of the gas supply opening amounts to 70 to 95% of a distance of tube plates limiting the tube bundle in the axial direction.

5. The heat exchanger according to claim 1, wherein a main axis of the chamber is oriented substantially horizontally.

6. The heat exchanger according to claim 1, wherein a drainage outlet is provided at the chamber.

7. The heat exchanger according to claim 1, wherein the chamber of the heat exchanger includes about 10 to 30% of the heat-exchange surface of the heat exchanger.

* * * * *